US010273772B2

(12) United States Patent
Mericas et al.

(10) Patent No.: US 10,273,772 B2
(45) Date of Patent: Apr. 30, 2019

(54) DRILLING DEBRIS SEPARATOR

(71) Applicant: Halliburton Energy Services, Inc., Houston, TX (US)

(72) Inventors: Christopher James Mericas, Houston, TX (US); Kevin Wayne Henry, Houston, TX (US); Todd Anthony Stair, Spring, TX (US); Luke Christopher Downy, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 124 days.

(21) Appl. No.: 15/509,087

(22) PCT Filed: Oct. 14, 2014

(86) PCT No.: PCT/US2014/060435
§ 371 (c)(1),
(2) Date: Mar. 6, 2017

(87) PCT Pub. No.: WO2016/060648
PCT Pub. Date: Apr. 21, 2016

(65) Prior Publication Data

US 2017/0275959 A1 Sep. 28, 2017

(51) Int. Cl.
*E21B 27/04* (2006.01)
*E21B 37/08* (2006.01)
(Continued)

(52) U.S. Cl.
CPC ..... *E21B 27/04* (2013.01); *E21B 21/002* (2013.01); *E21B 27/005* (2013.01); *E21B 37/00* (2013.01); *E21B 37/08* (2013.01); *E21B 43/10* (2013.01)

(58) Field of Classification Search
CPC ..... E21B 27/04; E21B 21/002; E21B 27/005; E21B 37/00; E21B 37/08; E21B 43/10
See application file for complete search history.

(56) References Cited

U.S. PATENT DOCUMENTS 4,857,175 A 8/1989 Spinnler
5,143,162 A 9/1992 Lyon et al.
(Continued)

FOREIGN PATENT DOCUMENTS

WO 00/58602 A1 5/2000

OTHER PUBLICATIONS

International Preliminary Report on Patentability issued in related Application No. PCT/US2014/060435, dated Apr. 27, 2017 (11 pages).

(Continued)

*Primary Examiner* — Yong-Suk Ro
(74) *Attorney, Agent, or Firm* — John W. Wustenberg; Baker Botts L.L.P.

(57) ABSTRACT

A debris separator device for use with a casing system is provided. The debris separator device may include an impeller having a plurality of blades to generate a vortex of mud in the section of the casing system when the casing system is lowered into a wellbore. The device may also include a baffle disposed in the section of the casing system, the baffle having an annular cup shape that forms an outer circumferential pocket to capture debris from the vortex of mud. The impeller and baffle may enable the debris separator device to separate debris and other debris from a flow of mud through the casing system so that the debris does not clog a float collar of the system. The disclosed debris separator device may be flushable so that the device does not become clogged with debris and can thereby maintain auto-fill through the casing system.

18 Claims, 5 Drawing Sheets

(51) Int. Cl.

| | |
|---|---|
| ***E21B 21/00*** | (2006.01) |
| ***E21B 27/00*** | (2006.01) |
| ***E21B 37/00*** | (2006.01) |
| ***E21B 43/10*** | (2006.01) |

(56) References Cited

U.S. PATENT DOCUMENTS

| | | | | |
|---|---|---|---|---|
| 5,490,571 | A * | 2/1996 | Hanns | B01D 19/0057 175/323 |
| 5,927,439 | A * | 7/1999 | Hanns | E21B 10/24 175/228 |
| 6,352,111 | B1 | 3/2002 | Bode et al. | |
| 6,382,318 | B1 | 5/2002 | Whitlock | |
| 7,093,653 | B2 | 8/2006 | Metcalfe et al. | |
| 7,188,687 | B2 | 3/2007 | Rudd et al. | |
| 8,657,910 | B2 | 2/2014 | Park et al. | |
| 2007/0056773 | A1 * | 3/2007 | Booth | E21B 17/22 175/57 |
| 2009/0084714 | A1 | 4/2009 | Schook | |
| 2010/0258296 | A1 | 10/2010 | Lynde et al. | |
| 2012/0273278 | A1 | 11/2012 | Zhu | |
| 2013/0168091 | A1 * | 7/2013 | Xu | E21B 27/00 166/301 |
| 2014/0014320 | A1 | 1/2014 | Soni et al. | |
| 2014/0216756 | A1 | 8/2014 | Getzlaf et al. | |

OTHER PUBLICATIONS

International Search Report and Written Opinion issued in related PCT Application No. PCT/US2014/060435 dated Jun. 30, 2015, 14 pages.

Extended European Search Report issued in related EP Application No. 14904165.9 dated Jan. 25, 2018 (8 pages).

* cited by examiner

DRILLING DEBRIS SEPARATOR

CROSS-REFERENCE TO RELATED APPLICATION

The present application is a U.S. National Stage Application of International Application No. PCT/US2014/060435 filed Oct. 14, 2014, which is incorporated herein by reference in its entirety for all purposes.

TECHNICAL FIELD

The present disclosure relates generally to well casing operations and, more particularly, to a device for separating debris from mud in an auto-filling casing system.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

When drilling a wellbore to the desired depth, a drill bit cuts into the subterranean formation, releasing cuttings of the formation into the wellbore. After drilling the wellbore to a desired depth, the cuttings left in the wellbore typically settle at the bottom of the wellbore. In vertically oriented wellbores, these cuttings fall to the bottom of the hole. However, in horizontally oriented or deviated wellbores, a portion of the cuttings cannot be removed and thus the cuttings can accumulate along the low side of the wellbore over long distances.

After drilling a wellbore that intersects a subterranean hydrocarbon-bearing formation, it is common practice to set a string of pipe, known as casing, in the well to isolate the various formations penetrated by the well from the wellbore. The casing may be run into the wellbore and cemented in place. In conventional cementing operations, a cement composition is displaced down the inner diameter of the casing until it exits the bottom of the casing into the annular space between the outer diameter of the casing and the wellbore. It is then pumped up the annulus until a desired portion of the annulus is filled.

Certain casing string systems allow for auto-fill while running the casing into the wellbore. Auto-fill enables mud from the wellbore to flow into the casing string through the "shoe" at the bottom of the casing string and up through the casing as the casing is lowered into the wellbore. As the casing string is run to depth in deviated wells, cuttings and debris along the low side of the wellbore can enter the casing shoe track. If the casing string is equipped with an auto-filling float collar, these cuttings can be swept into the main casing string. Unfortunately, accumulation of debris above the float collar can negatively affect cementing operations by preventing a plug from sealing properly on the float collar. Cuttings can also become lodged in the float valve and cause clogging and loss of auto-fill. This clogging may prevent the casing string from auto-filling, causing the casing string to act as a plunger forcing mud into the formation, which could prematurely fracture the formation. This clogging could also cause the float valves to not function properly, which could disable the primary function of the equipment. Some existing casing string systems include filters to prevent this debris from reaching the main casing string while running the casing. However, existing systems with the filters can become clogged and cannot be flushed out once clogged.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for running a string of casing to depth while maintaining auto-fill operations and preventing formation cuttings and downhole debris from entering the main string of casing. To that end, presently disclosed embodiments include a casing system that includes a series of stationary impellers in tandem with a series of baffles or baskets to separate the heavy debris and drill cuttings from the mud of the wellbore. As the auto-filling casing string is lowered into the wellbore, mud and cuttings/debris present in the wellbore may be swept up into the casing system. The impellers may generate a vortex of the mud and debris flowing past the impeller blades, and the centrifugal force of the vortex may sweep the cuttings and other heavy debris toward the annular baffles along the outer edge of the casing system. The baffles may catch the cuttings/debris, keeping them from entering the main string of casing above a float collar of the casing system. This allows the mud to constantly flow through the main casing string via auto-fill without the debris and cuttings getting stuck in the float collar. The disclosed casing system may enable an operator to flush the collected cuttings/debris from the baffles as needed to keep the casing system from packing off or becoming clogged.

Figure 1:
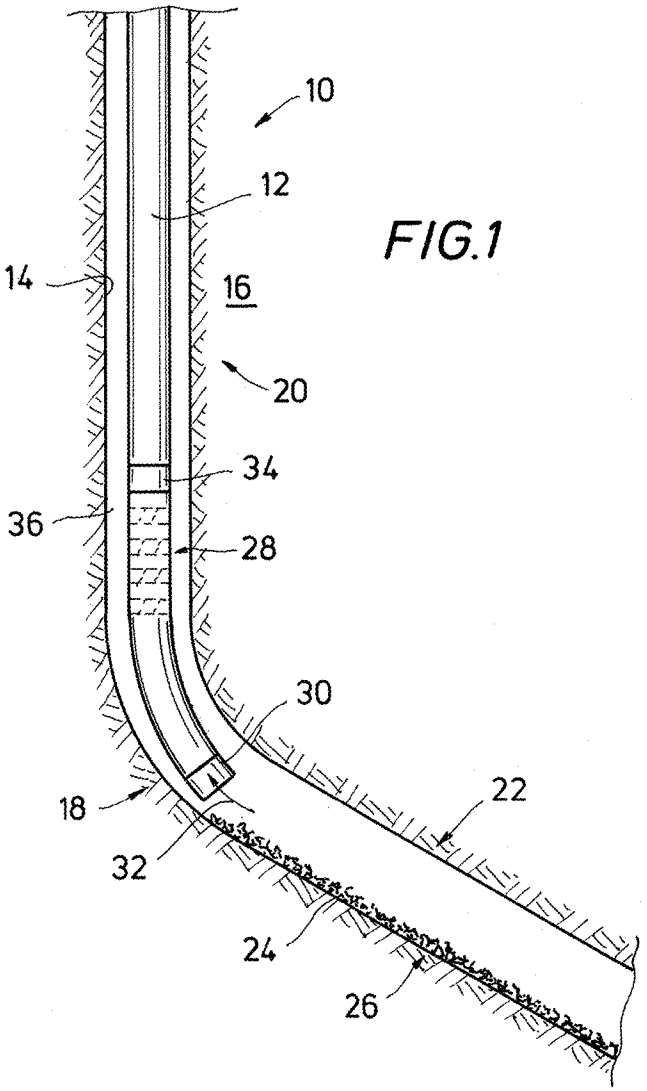
FIG. 1 is a partial cross-sectional view of a casing string being run into a deviated wellbore, in accordance with an embodiment of the present disclosure.

Referring to FIG. 1, illustrated is an exemplary downhole casing system 10, according to one or more embodiments disclosed. As depicted, the casing system 10 may include a casing string 12 that is being lowered into a wellbore 14 formed through a subterranean formation 16. As illustrated, the casing system 10 may be configured to be lowered into a heel portion 18 of the wellbore 14. The heel portion 18 may transition the wellbore 14 from a substantially vertically oriented section 20 of the wellbore 14 to a deviated (e.g., relatively horizontal or slanted) section 22 of the wellbore 14.

Prior to the casing system 10 being lowered into the wellbore 14 as shown, the wellbore 14 may have been drilled to a certain depth via a drill string having a drill bit attached thereto. This previous drilling operation may have generated cuttings 24 or other debris from the drill bit cutting into the formation 16 to create the wellbore 14. As illustrated, these cuttings 24 may be distributed in a layer across a lower wall 26 of the deviated section 22 of the wellbore 14 as the casing string 12 is being run into the well.

The casing system 10 may include a debris separator device 28 that is used to separate the cuttings 24 from the mud flowing through the casing system 10 as the casing string 12 is run to depth. The debris separator device 28 may be run in with the casing string 12, at the bottom of the casing system as shown. For example, the debris separator device 28 may make up the bottom forty feet of the casing system 10 being lowered into the wellbore 14.

In disclosed embodiments, the casing system 10 may facilitate auto-fill operations while the casing system 10 is being lowered. The auto-fill operations enable downhole fluid (e.g., mud) to flow into the casing system 10 and up through the casing string 12 as the casing string 12 is being lowered. This may allow the casing system 10 to be run in to the wellbore 14 without a surface-mounted hydraulic pump being used to circulate fluid through the wellbore 14. Instead, as the casing system 10 is pushed downward through the wellbore 14, the mud may enter the casing system 10 via a float shoe 30 of the casing system 10, as shown by arrow 32. This flow of mud into the casing system 10 is created as a result of running the casing system 10 into the wellbore 14 filled with mud and cuttings 24. The mud may continue to flow through the debris separator device 28, through a float collar 34, and into the casing string 12.

Later, when performing a cementing operation, the casing system 10 may push cement downward through the casing string 12, float collar 34, debris separator device 28, and float shoe 30, and into an annulus 36 between the casing system 10 and the wellbore 14. The cement may push the mud back out of the casing string 12. The float collar 34 may include check valves designed to facilitate a one-way flow of fluid and cement through the float collar 34 during the cementing operation. When operating as desired, the check valves close to prevent cement from creeping or flowing back up the casing string 12. This may allow the cement to set up in the annulus 36, thereby completing the cementing job. When the cementing job is completed, the debris separator device 28 and the float shoe 30 may be filled with cement along with the annulus. From this point, the well may be completed or another drilling tool may be lowered and used to drill out the end of the casing system 10.

The debris separator device 28 may be used to capture and control the amount of cuttings 24 that flow into the casing system 10 with the mud as the casing system 10 is lowered. For example, the debris separator device 28 may keep the cuttings 24 from interfering with operation of the float collar 34. Specifically, if the cuttings 24 were to interfere with the check valve of the flow collar 34, the check valve might fail to close after cement is run into the wellbore 14, thereby compromising the ability of the cement to flow into and properly set in the bottom of the casing system 10. To prevent this from happening, the debris separator device 28 may include one or more impellers and baffles that are used to capture and periodically flush out cuttings 24 that enter the casing system 10 before the cuttings 24 reach the float collar 34.

In addition, the debris separator device 28 may capture and maintain the cuttings 24 in designated pockets (baffles) of the debris separator device 28 while leaving a flow path open through the center. This may prevent the cuttings 24 from bridging at the float collar 34. The term "bridging" refers to a large amount of cuttings 24 that might gather uphole of the check valve in the float collar 34 and act as a barrier that filters larger solids out of the cement mixture during the cementing process. In effect, this bridging may filter the cement so that a more watery cement substance than desired is output into the annulus 36 of the wellbore 14. As described in detail below, the disclosed debris separator device 28 may include baffles that capture and retain the cuttings 24 about an annular portion of the device, in order to prevent the occurrence of such bridging.

While FIG. 1 depicts the system 10 as being arranged in the heel portion 18 of a horizontally-oriented wellbore 14, it will be appreciated that the system 10 may be equally arranged in a vertical or slanted portion of the wellbore 14, or any other angular configuration therebetween, without departing from the scope of the disclosure. Additionally, the system 10 may be arranged along other portions of the deviated section 22 of the wellbore 14 in order to secure the casing string 12 within a portion of the wellbore 14 without the interference of cuttings 24 and other particles entering the casing string 12.

Figure 2:
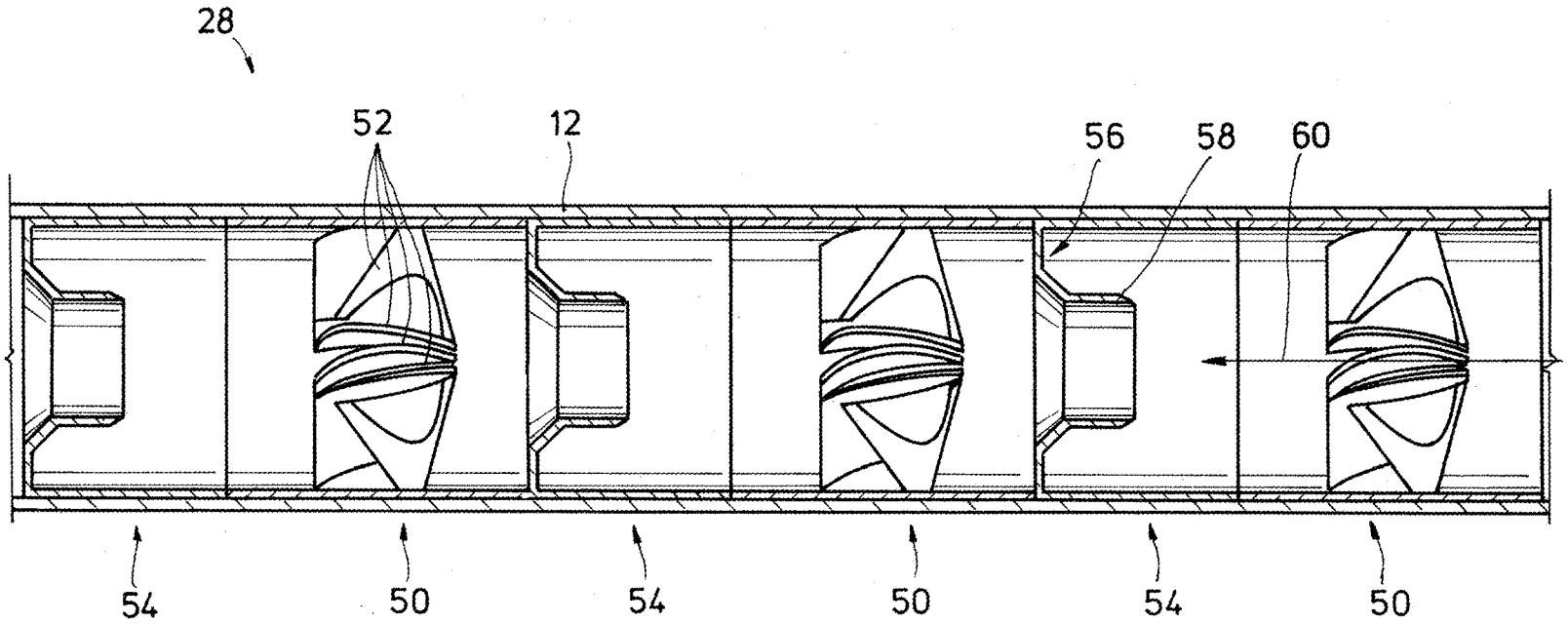
FIG. 2 is a cross sectional view of a debris separator device in the casing system of FIG. 1, in accordance with an embodiment of the present disclosure.

Having now described the context in which the debris separator device 28 may be used, a more detailed description of the debris separator device 28 will be provided. FIG. 2 illustrates an embodiment of the disclosed debris separator device 28. The debris separator device 28 may include an impeller 50 having a plurality of blades 52 designed to generate a vortex of mud in the debris separator device 28 as the casing string 12 is lowered into the wellbore. As illustrated, the debris separator device 24 may include several such impellers 50 disposed at intervals along the length of the device. As debris laden mud enters the shoe track of the casing system from the wellbore, the mud may begin to rotate and form a vortex as it passes over the impeller blades 52. In some embodiments, the impellers 50 are stationary with respect to the casing string 12, so that the fluid rotates as a result of the force of the fluid passing over the blades 52. As the fluid vortex rotates, the cuttings, debris, and other heavier particles in the mud may be thrown to the outer circumferential section of the vortex due to the cen-trifugal inertia of these heavier particles. Thus, the impeller 50 may function to centrifuge the mud.

The debris separator device 28 may also include a baffle 54 designed to catch these heavy particles that are thrown to the outside of the mud vortex via the impeller 50. Specifically, the baffle 54 may feature an annular cup shape that forms an outer circumferential pocket 56 within the debris separator device 28 to capture cuttings from the vortex of mud generated by the impeller 50. In some embodiments, the baffle 54 may also include a reduced diameter nozzle 58 that forms a wall of the annular pocket 56 and directs surface-pumped fluid through the center of the debris separator device 28 to draw the cuttings out of the outer circumferential pocket 56 when desired. The reduced diameter nozzle 58 may enable clean mud to pass through the center of the baffle 54 toward the float collar and main casing string described above.

As illustrated, the debris separator device 28 may include several such baffles 54 disposed periodically along the length of the debris separator device 28. In some embodiments, the baffles 54 and impellers 50 may be positioned along the length of the debris separator device 28 in an alternating fashion, although other arrangements may be used in other embodiments. As illustrated, one or more of the baffles 54 may be disposed adjacent a corresponding impeller 50 such that, as the casing string 12 is lowered into the wellbore, the mud enters the section of the casing string 12 (in a direction indicated by arrow 60) and moves across the impeller 50 toward the baffle 54. This may allow the impeller 50 to force the mud into a vortex prior to the mud reaching the baffle 54.

Figure 3:
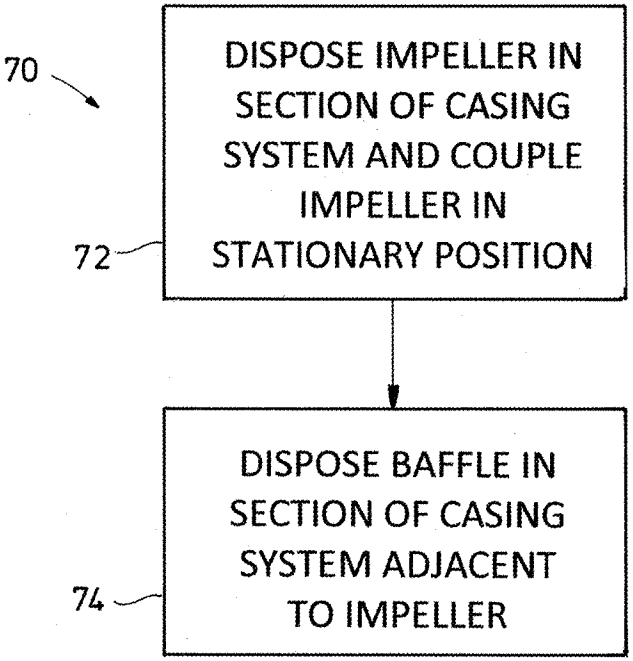
FIG. 3 is a process flow diagram of a method for manufacturing the debris separator device of FIG. 2, in accordance with an embodiment of the present disclosure.

In the illustrated embodiment, the debris separator device 28 may include one or more impellers 50 and one or more baffles 54 disposed in a lower section of the casing string 12 of FIG. 1. However, it should be noted that several different arrangements, configurations, and methods of manufacturing the debris separator device 28 may be utilized in accordance with present embodiments. FIG. 3 illustrates a general method 70 for assembling the debris separator device 28, and the method 70 may encompass several specific assembly techniques described below.

As shown in FIG. 3, the method 70 for manufacturing the debris separator device may include disposing (block 72) the impeller in a section of the casing system and coupling the impeller in a stationary position with respect to the casing system. The method 70 may also include disposing (block 74) a baffle in the section of the casing system adjacent to the impeller. This general method 70 may be accomplished in several different ways. For example, the impellers 50 and the baffles 54 of FIG. 2 may be installed in the form of inserts disposed inside a portion of the casing string 12. That is, each impeller 50 and each baffle 54 may be formed as a single insert that can be positioned within the inner diameter of a length of casing.

Figure 4:
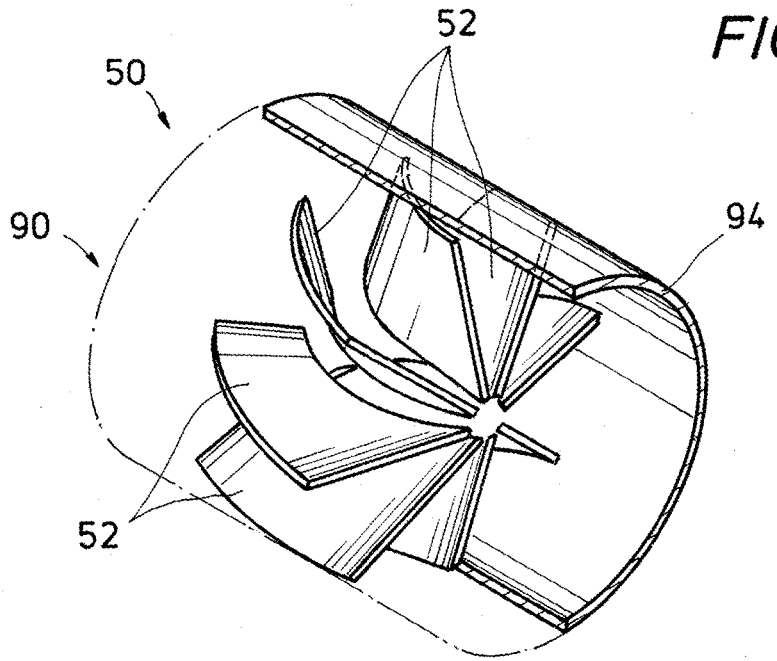
FIG. 4 is a perspective view of an impeller that may be used in the debris separator device of FIG. 2, in accordance with an embodiment of the present disclosure.
Figure 5:
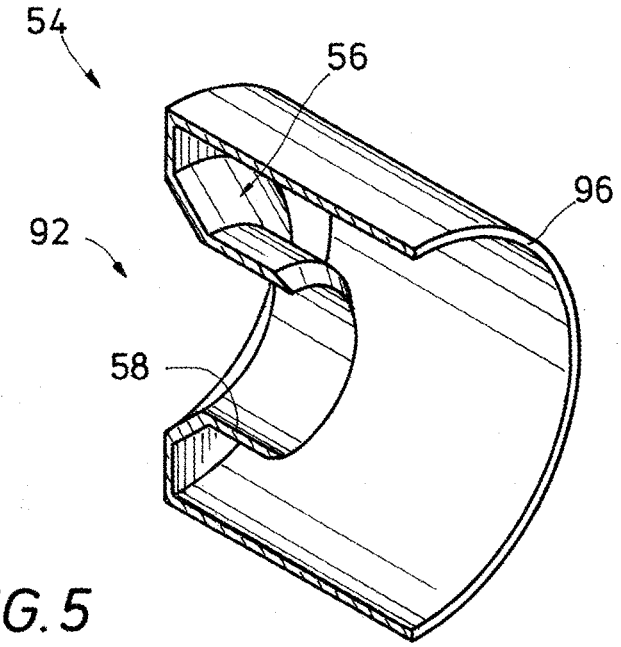
FIG. 5 is a cutaway perspective view of a baffle that may be used in the debris separator device of FIG. 2, in accordance with an embodiment of the present disclosure.

FIGS. 4 and 5 illustrate embodiments of an impeller insert 90 and a baffle insert 92, respectively. As shown in FIG. 4, the impeller insert 90 may include an outer circumferential wall 94 that surrounds the plurality of impeller blades 52. As discussed above, the impeller 50 may include stationary blades 52 that are not designed to rotate with respect to the casing system. Accordingly, the blades 52 of FIG. 4 may be coupled and held stationary with respect to the outer circumferential wall 94 of the impeller insert 90. The impeller insert 90 may be disposed in a length of casing and attached to an inner surface of the casing string to secure the impeller 50 within the casing system.

As illustrated in FIG. 5, the baffle insert 92 may also include an outer circumferential wall 96 that surrounds the outer circumferential pocket 56 and the reduced diameter nozzle 58 of the baffle 54. The baffle insert 92 may be disposed in a length of casing and attached to an inner surface of the casing string to secure the baffle 54 within the casing system at a desired position relative to the impeller insert 90. The impeller insert 90 and the baffle insert 92 may include outer circumferential walls 94 and 96 that are approximately the same inner and outer diameters, in order to create a smooth internal flow path for mud that enters the casing system as the system is lowered into the wellbore. These inserts 90 and 92 may be relatively easy to stack against each other, allowing a user to install as many or as few inserts as desired by simply placing the inserts 90 and 92 inside a portion of casing. For example, the user may install these inserts into the shoe track behind the casing shoe of the casing system. Accordingly, the inserts 90 and 92 may facilitate a plurality of impellers 50 and baffles 54 that are attachable to one another to form a string of impellers 50 and baffles 54 of any length and having any ratio of impellers 50 to baffles 54. Any desirable number of impeller inserts 90 and baffle inserts 92 may be utilized to form this string of components.

In other embodiments, the impeller 50 and the baffle 54 may be components that are attachable to one another to form the debris separator device 28 shown in FIG. 1 without being installed as inserts. As illustrated in FIG. 1, the debris separator device 28 may include a device that is installed between two other pieces or tools of the casing system 10. For example, in the illustrated embodiment, the debris separator device 28 having the impellers and baffles may be a separate component coupled between the float collar 34 and the float shoe 30. In some embodiments, this debris separator device 28 may include impellers and baffles that are built into a cement mounted casing sub that is attachable to other portions of the casing system (e.g., float shoe 30, float collar 34). In other embodiments, the impellers and baffles of the debris separator device 28 may include attachment features that enable the components to latch in or be threaded onto the float shoe 30 or the float collar 34, the float collar 34 being made up to the end of another tool or being made up to the main casing string 12.

In still other embodiments, the debris separator device 28 may include a long, pre-made up string of impellers and baffles that is inserted ahead of the float shoe 30 in the casing system 10. The impellers and baffles may be separate parts that are stacked in series to form the impeller/baffle string that is later inserted into the casing system 10. In other embodiments, the impellers and baffles may be combined into one single part and several of these parts may then be stacked in series.

Figure 6:
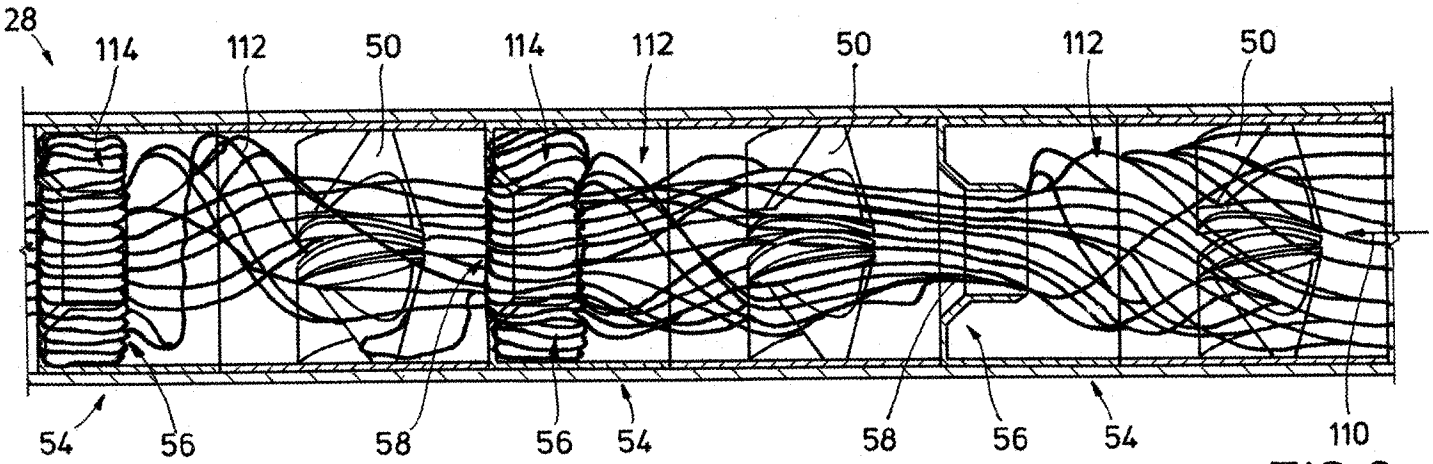
FIG. 6 is a schematic view illustrating a flow of mud through the debris separator device of FIG. 2 to capture debris, in accordance with an embodiment of the present disclosure.

Having now described the general structure and methods of manufacturing the disclosed debris separator device 28, a more detailed description of the functions performed by the debris separator device 28 will be provided. To that end, FIG. 6 illustrates an embodiment of the debris separator device 28 being used to separate debris (e.g., drill cuttings) out of the mud flowing through the casing system 10. As fluid (e.g., mud with cuttings) enters the debris separator device 28, as shown by arrow 110, the fluid passes over the first impeller 50 and begins to rotate. As the fluid continues to flow through the debris separator device 28, the fluid passes over additional impellers 50, causing the fluid to rotate more and to form a vortex 112. The vortex 112 may include fluid rotating such that lighter weight particles in the fluid are maintained toward the center of the vortex 112 and heavier particles are thrown to the outside of the vortex 112 due to the momentum from centrifugal force on the heavier particles. Thus, the heavy debris, cuttings, and other particles may be thrown to the outside of the vortex 112 and become trapped in the circumferential pockets 56 formed by the baffles 54. A relatively clean fluid may then flow through the reduced diameter nozzles 58 of the baffles 54, as shown. This clean fluid may continue to flow through the debris separator device 28, through the float collar 34 of FIG. 1, and through the casing string 12 to enable auto-fill of the casing system 10.

FIG. 6 illustrates the fluid flow path through the debris separator device 28, not the particle flow path. As illustrated, the vortex 112 may cause the fluid to form a high pressure, low velocity flow 114 through the pockets 56 of the baffles 54. The flow path of particles through the debris separator device 28 may mirror the illustrated flow path of the fluid. After being thrown toward the annular pockets 56, the heavy particles may have a more difficult time escaping the high pressure, low velocity flow 114 in the pockets 56 than the fluid illustrated.

Figure 7:
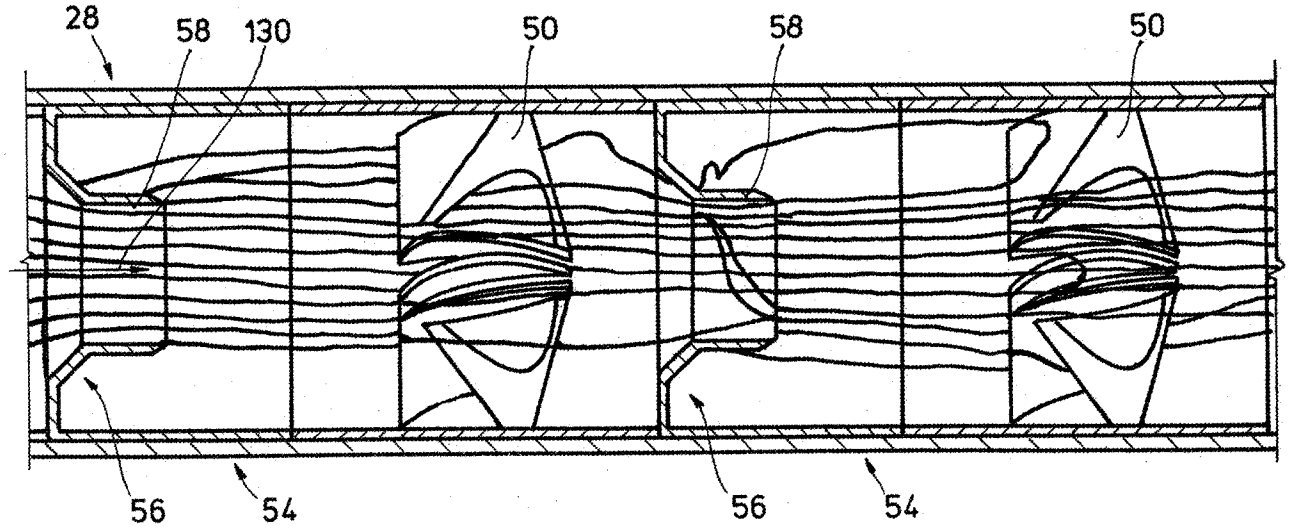
FIG. 7 is a schematic view illustrating a flow of fluid through the debris separator device of FIG. 2 to flush debris out of the casing string, in accordance with an embodiment of the present disclosure.

At times throughout use of the debris separator device 28, the pockets 56 may become filled entirely with the cuttings and other particulate separated from the mud flow through the device. At such times, it may be desirable to flush the debris from the debris separator device 28, while still keeping the debris from entering the main casing string. To that end, the debris separator device 28 may be designed to facilitate such flushing of the debris from the pockets 56. FIG. 7 illustrates the fluid flow paths through the device 28 during this flushing process.

To begin, fluid may be circulated from the surface of the wellbore through the casing string, through the debris separator device 28, and out into the annulus surrounding the casing system. This fluid may include mud that is hydraulically pumped down the casing system from the surface. Once the fluid is circulated from the surface to the debris separator device 28 (shown by arrow 130), the impellers 50 in the debris separator device 28 may again facilitate rotation of the fluid flow. However, in this operation the baffles 54 are oriented in an opposite direction of the fluid flow, such that the fluid does not become trapped in the pockets 56. Instead, the fluid may flow at high rates through the center of the baffles 54 via the nozzles 58, creating a low pressure zone at the center of the debris separator device 28. These high flow rates may induce a vacuum through the center of the baffles 54 that removes the heavy particles from the baffle pockets 56, allowing the shoe track of the casing string to be flushed. That is, the fluid flow circulated from the surface may generate a vacuum pressure to draw the cuttings out of the baffle 54 and to expel the flow of mud and cuttings from the debris separator device 28 and into the wellbore.

By enabling flushing of the baffle pockets 56, the debris separator device 28 may not be susceptible to undesirable pack-off of the filter elements. That is, if the pockets 56 become full of cuttings or other material, then these materials can be swept out of the casing system before the casing system proceeds further downhole. In this manner, the debris separator device 28 may not become so full of debris that the debris prevents the mud from flowing through the debris separator device 28 and into the main casing string 12. Thus, the disclosed debris separator device 28 may maintain auto-filling operations of the casing system while filtering out the undesirable debris from the mud flow. Existing filter systems do not facilitate this selective flushing of the filters while running the casing and, therefore, are susceptible to losing auto-fill functionality. The ability to flush the presently disclosed debris separator device 28 may enable a relatively more flexible system for removing debris and cuttings from an auto-fill flow of mud through a casing string.

Although the design of the debris separator device 28 may enable flushing if the device becomes full of debris, it may be desirable for the debris separator device 28 to be designed such that it does not reach the point where it is full of debris. To that end, the debris separator device 28 may be formed from a large enough number of baffles 54 and impellers 50 that would ensure that enough storage volume is present within the many pockets 56 of the baffles 54 to collect all the cuttings that are likely to be drawn into the device. This may reduce the likelihood of cuttings being swept above the debris separator device 28 and on through the float collar to the main casing string. However, if debris does fill all the available pockets 56 and begin to flow through the debris separator device 28, the device 28 may simply be flushed via the circulation of fluid from the surface to clear the pockets 56. After flushing the debris separator device 28, the casing string may be further run into the wellbore.

Figure 8:
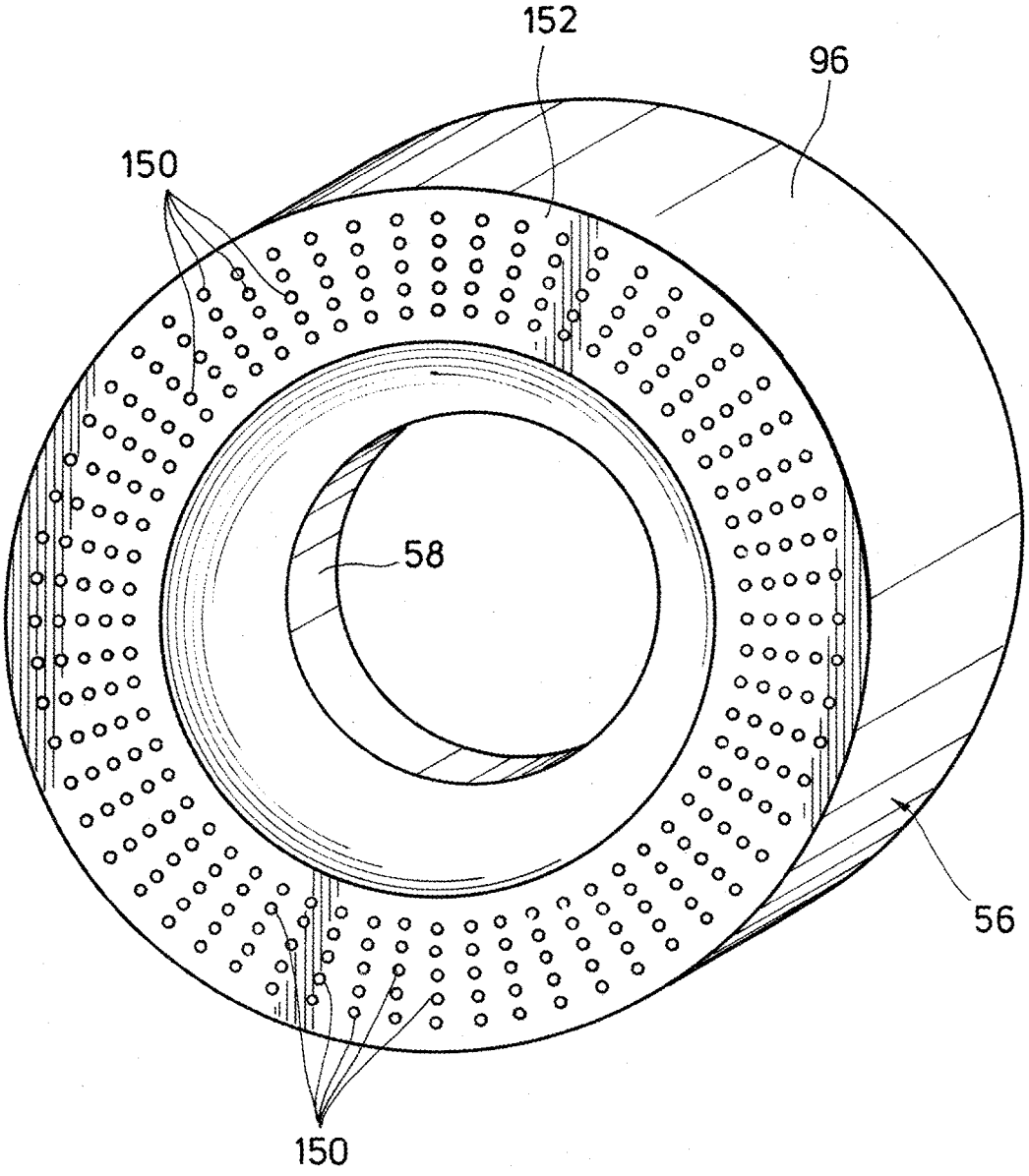
FIG. 8 is a perspective view of a baffle having perforations, in accordance with an embodiment of the present disclosure.

In some embodiments of the debris separator device, one or more of the baffles 54 may include small perforations 150 formed therein, as illustrated in FIG. 8. The illustrated baffle 54 may include a plurality of small perforations 150 formed into a collecting edge 152 of the baffle 54. The collecting edge 152 refers to an edge or face of the baffle 54 formed between the nozzle 58 and the outer circumferential wall 96 of the baffle 54 where the cuttings may be collected. The perforations 150 may be small enough to allow certain amounts of fluid to pass through the circumferential pocket 56 of the baffle 54 while still maintaining the larger debris and cuttings within the pocket 56. Thus, the perforations 150 may increase the capacity of the pocket 56 to contain the heavy particles separated from the mud flow through the debris separator device. Other sizes, types, and arrangements of perforations 150 may be utilized in other embodiments.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

an impeller disposed in a section of a casing system, the impeller comprising a plurality of blades to generate a vortex of mud in the section of the casing system when the casing system is lowered into a wellbore; and a baffle disposed in the section of the casing system, the baffle having an annular cup shape that forms an outer circumferential pocket within the section of the casing system to capture debris from the vortex of mud generated by the impeller, wherein the baffle comprises perforations along a face of the baffle to allow fluid to flow through the outer circumferential pocket while capturing the debris.

2. The system of claim 1, wherein the impeller comprises a stationary impeller having a plurality of blades to force the mud to rotate in response to the mud moving past the impeller when the casing system is lowered into the wellbore.

3. The system of claim 1, wherein the baffle is disposed adjacent the impeller such that, as the casing system is lowered into the wellbore, the mud enters the section of the casing system and moves across the impeller toward the baffle.

4. The system of claim 1, wherein the baffle comprises a reduced diameter nozzle that directs fluid pumped from the surface through the center of the section of the casing system to draw the debris out of the outer circumferential pocket.

5. The system of claim 1, wherein the section of the casing system comprises a casing sub that is attachable to other portions of the casing system.

6. The system of claim 1, further comprising a float shoe disposed at one end of the section of the casing system, wherein the impeller and the baffle are coupled to the float shoe.

7. The system of claim 1, further comprising a float collar disposed at one end of the section of the casing system, wherein the impeller and the baffle are coupled to the float collar.

8. The system of claim 1, further comprising a plurality of impellers and baffles coupled together and disposed in the section of the casing system.

9. The system of claim 1, wherein the impeller and the baffle are inserts that are attachable to an inside surface of a casing string.

10. The system of claim 1, further comprising a plurality of impellers and baffles that are attachable to one another to form a string of impellers and baffles of any length and having any ratio of impellers to baffles.

11. A method comprising:

receiving mud into an assembly disposed in a section of a casing system as the casing system is lowered into a wellbore;

centrifuging the mud via an impeller disposed in the assembly to generate a vortex of mud in the section of the casing system;

capturing debris from the vortex of mud via a baffle disposed in the section of the casing system and having an annular cup shape that forms an outer circumferential pocket; and maintaining the debris in the outer circumferential pocket and away from a main casing string of the casing system adjacent the section of the casing system having the impeller and the baffle.

12. The method of claim 11, further comprising:

directing a flow of mud from an upper section of the casing system into the section of the casing system having the impeller and the baffle and through a center of the baffle defined by the annular cup shape;

generating a vacuum pressure to draw the debris out of the baffle via the flow of mud through the center of the baffle; and expelling the flow of mud and the debris from the section of the casing system and into the wellbore.

13. The method of claim 11, further comprising urging a rotation of the mud via the plurality of blades of the impeller as the mud flows past the impeller, wherein the impeller is stationary with respect to the section of the casing system.

14. The method of claim 11, further comprising enabling the mud to flow out of the outer circumferential pocket of the baffle via perforations in the outer circumferential pocket while maintaining the debris in the outer circumferential pocket.

15. A method, comprising:

disposing an impeller in a section of a casing system and coupling the impeller in a stationary position within the section of the casing system, the impeller comprising a plurality of blades to generate a vortex of mud in the section of the casing system when the casing system is lowered into a wellbore;

disposing a baffle in the section of the casing system adjacent the impeller, the baffle having an annular cup shape that forms an outer circumferential pocket within the section of the casing system to capture debris from the vortex of mud generated by the impeller; and maintaining the debris in the outer circumferential pocket and away from a main casing string of the casing system adjacent the section of the casing system having the impeller and the baffle.

16. The method of claim 15, further comprising coupling the impeller and the baffle to a float collar or a float shoe.

17. The method of claim 15, wherein the section of the casing system comprises a cement mounted casing sub.

18. The method of claim 15, coupling the impeller and the baffle to each other prior to disposing the impeller and the baffle in a string of casing.

* * * * *